US007285521B2

(12) United States Patent
Chakrabarty et al.

(10) Patent No.: US 7,285,521 B2
(45) Date of Patent: Oct. 23, 2007

(54) DETERGENT COMPOSITION COMPRISING PREDOMINANTLY SOAP AND PALYGORSKITE CLAY

(75) Inventors: Debojit Chakrabarty, Bangalore (IN); Anant Kondiram Parte, Mumbai (IN); Yashodhara Pawar, Bangalore (IN)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 11/051,775

(22) Filed: Feb. 4, 2005

(65) Prior Publication Data

US 2005/0187129 A1 Aug. 25, 2005

(30) Foreign Application Priority Data

Feb. 6, 2004 (IN) ..... 138/MUM/2004

(51) Int. Cl.
*C11D 9/02* (2006.01)
*C11D 3/08* (2006.01)

(52) U.S. Cl. ..... 510/152; 510/130; 510/141; 510/447; 510/451; 510/454; 510/507; 510/511; 510/481; 510/485; 510/491

(58) Field of Classification Search ..... 510/130, 510/141, 152, 447, 451, 454, 507, 511, 481, 510/485, 491
See application file for complete search history.

(56) References Cited

U.S. PATENT DOCUMENTS

| | | | | | |
|---|---|---|---|---|---|
| 2,594,258 | A | | 4/1952 | Durgin | |
| 3,137,622 | A | | 6/1964 | Mueller et al. | |
| 4,129,423 | A | * | 12/1978 | Rubin | 510/398 |
| 4,264,466 | A | * | 4/1981 | Carleton et al. | 510/304 |
| 4,388,301 | A | * | 6/1983 | Klein | 424/684 |
| 4,842,903 | A | * | 6/1989 | Hayner | 428/467 |
| 4,847,089 | A | | 7/1989 | Kramer et al. | |
| 4,885,109 | A | | 12/1989 | Umemoto et al. | |
| 4,941,989 | A | * | 7/1990 | Kramer et al. | 510/372 |
| 5,062,994 | A | * | 11/1991 | Imperatori | 510/141 |
| 5,225,098 | A | * | 7/1993 | Kacher et al. | 510/146 |
| 5,227,086 | A | * | 7/1993 | Kacher et al. | 510/146 |
| 5,264,145 | A | | 11/1993 | French et al. | |
| 5,720,961 | A | * | 2/1998 | Fowler et al. | 424/401 |

FOREIGN PATENT DOCUMENTS

| | | | |
|---|---|---|---|
| DE | 37 42 491 | A1 | 6/1988 |
| DE | 100 08 815 | A1 | 8/2001 |
| EP | 0215108 | B1 | 3/1987 |
| ES | 8602923 | A | 3/1986 |
| JP | 60184599 | A | 9/1985 |
| JP | 07331283 | A | 12/1995 |
| JP | 9-87687 | | 3/1997 |
| JP | 10-45565 | | 2/1998 |
| KR | 200116083 | A | 3/2001 |

OTHER PUBLICATIONS

International Search Report Application No. PCT/EP 2005/000791 mailed Apr. 6, 2005.
Search Report under Section 17 Application No. GB 0413181.9, Jun. 4, 2005.

* cited by examiner

*Primary Examiner*—Charles Boyer
(74) *Attorney, Agent, or Firm*—Ronald A. Koatz

(57) ABSTRACT

The invention relates to a synergistic detergent composition capable of reducing oiliness or greasiness of the skin and also reduce post wash re-accumulation of sebum on the skin. It is particularly preferred to formulate the composition as a wash off product by incorporating a clay belonging to the hormite group of the 2:1 type of clay minerals, and having an inverted ribbon configuration.

9 Claims, No Drawings

DETERGENT COMPOSITION COMPRISING PREDOMINANTLY SOAP AND PALYGORSKITE CLAY

The invention relates to a synergistic detergent composition capable of reducing oiliness or greasiness of the skin, and also reducing post wash re-accumulation of sebum on the skin. It is particularly preferred to formulate the composition as a wash off product.

Conventional detergent bars, based on soap for personal washing, contain over about 70% by weight total fatty matter (TFM), the remainder being water (about 10% to 20%) and other ingredients such as colour, perfume, preservatives, etc. Structurants and fillers are also present in such compositions in small amounts that replace some of the soap in the bar while retaining the desired hardness of the bar. The commonly used fillers include starch, kaolin and talc. Cleansing compositions are formulated in various forms such as bars, liquids, gels, pastes, etc.

Sebum is produced by the disruption of the cells in which it is formed (e.g. in the basal layer of the gland). This function may be termed holocrine secretion. Being liquid inside the duct and hair follicle, sebum diffuses up and down the follicular canal. Upon reaching the skin surface, it combines with epithelial lipids (from the keratinizing cells) and emulsifies as an oily liquid with water from the sweat glands.

The quantity of sebum produced is directly proportional to the size of the gland, which in turn depends on the level of androgens and body temperature and weight. The rate of sebum production varies in different individuals, some having oilier skins than others.

The literature is replete with methods and compositions for eliminating, treating or at least reducing the levels of skin oils and greasiness. Various leave on, wash off and face pack type of products have been formulated for the purpose.

JP 10045565 (Kao, 1998) discloses a detergent composition capable of effectively removing with a make-up cosmetic or sebum and having low irritation to skin comprising a nonionic surfactant and a water-swellable clay mineral therein. However, it does not teach the method to reduce the re-accumulation of sebum on the skin that makes the skin feel oily after a period of time. They are also restricted to the use of nonionic surfactants.

JP 09087687 (Nendo Kagaku Kenkyusho, 1997) discloses fatty acid soap compositions comprising sodium montmorillonite or pectolite of the group smectite to formulate products that are mild and non-irritating to skin, excellent in washing ability, and highly contributing to the cure of atopic dermatitis. This however does not teach how to reduce the re-accumulation of sebum on the skin after wash-off process.

EP 215108 (Neutrogena, 1992) discloses a facial mask composition comprising kaolin and bentonite for the treatment of acne.

U.S. Pat. No. 3,137,622 (Mueller et al, 1964) discloses that the clay mineral attapulgite, and particularly colloidal attapulgite, has the ability to act with certain hydroxylated aromatic compounds to effectively arrest acne. The composition disclosed is in the form of stable gels or highly thickened systems which turn to a dry composition after a period of controlled residence on the skin, and hence the dripping of the formulation from the face is avoided. This does not however teach the detergent based formulations which are generally wash-off products.

U.S. Pat. No. 4,885,109 (Kao, 1989) discloses a quick-drying pack-type face-cleansing composition comprising sebum-absorbing powder, water-repellant powder, a non-ionic surfactant having an HLB of 12-18, and water. The sebum-absorbing powder may preferably be powder of bentonite, kaolin, talc, organobentonite, sericite, mica, silica, silicates, zeolite, diatomaceous earth, barium sulphate, calcium carbonate, polyvinyl chloride, polypropylene, polymethyl methacrylate, a polymer of an acrylic acid derivative, nylon, or polystyrene.

Traditionally, various clays have been topically applied to provide skin benefits. These formulations are generally face-pack type formulations, and not detergent based wash-off products.

It has now been found that use of attapulgite in predominantly soap based personal washing compositions provide enhanced benefit for removal of sebum from the skin surface, and reduces re-accumulation after a period of time.

This property of reducing re-accumulation of sebum is surprisingly obtained when attapulgite is used, which is not obtained when other types of clays such as e.g. bentonite, bentonite/kaolinite mixtures, or talc are used.

It is an object of the present invention to be ale to provide a detergent composition comprising a clay belonging to the hormite group of the 2:1 type of clay minerals, having an inverted ribbon configuration, and also having sorptive character.

It is another object of the present invention to be able to provide a personal wash detergent composition comprising a clay belonging to the hormite group of the 2:1 type of clay minerals, and having an inverted ribbon configuration, and also having sorptive character to reduce oiliness and greasiness of the skin.

It is yet another object of the present invention to be able to provide a personal wash detergent composition comprising a clay belonging to the hormite group of the 2:1 type of clay minerals, having an inverted ribbon configuration and also having sorptive character to reduce post wash re-accumulation of sebum on the skin.

Thus according to a first aspect of the present invention there is provided a detergent composition comprising 10% to 80% wt. detergent active, 1% to 60% by wt. clay belonging to the hormite group of the 2:1 type of clay minerals, and having an inverted ribbon configuration and also having sorptive character, and optionally other conventional ingredients.

According to a preferred aspect of the present invention there is provided a detergent composition comprising 20% to 80% wt. detergent active, 10% to 60% by wt. clay belonging to the hormite group of the 2:1 type of clay minerals, and having an inverted ribbon configuration and also having sorptive character, and optionally other conventional ingredients.

The invention is thus directed to a personal wash detergent composition, preferably a detergent bar composition, which preferably comprises clay belonging to the hormite group of the 2:1 type of clay minerals, and having an inverted ribbon configuration and also having sorptive character to effectively reduce oil and grease secretion from skin surface and follicular pores, and provide delayed re-accumulation of sebum post-wash.

The detergent active used in the process may be soap or non-soap surfactants. The term total fatty matter, usually abbreviated to TFM is used to denote the percentage by weight of fatty acid and triglyceride residues present in soaps without taking into account the accompanying cations.

For a soap having 18 carbon atoms, an accompanying sodium cation will generally amount to about 8% by weight. Other cations may be employed as desired for example zinc, potassium, magnesium, alkyl ammonium and aluminium.

The term soap denotes salts of carboxylic fatty acids. The soap may be derived from any of the triglycerides conventionally used in soap manufacture—consequently the carboxylate anions in the soap may typically contain from 8 to 22 carbon atoms.

The soap may be obtained by saponifying a fat and/or a fatty acid. The fats or oils generally used in soap manufacture may be such as tallow, tallow stearines, palm oil, palm stearines, soya bean oil, fish oil, caster oil, rice bran oil, sunflower oil, coconut oil, babassu oil, palm kernel oil, and others. In the above process the fatty acids are derived from oils/fats selected from coconut, rice bran, groundnut, tallow, palm, palm kernel, cotton seed, soybean, castor etc. The fatty acid soaps can also be synthetically prepared (e.g. by the oxidation of petroleum or by the hydrogenation of carbon monoxide by the Fischer-Tropsch process). Resin acids, such as those present in tall oil, may be used. Naphthenic acids are also suitable.

Tallow fatty acids can be derived from various animal sources and generally comprise about 1% to 8% myristic acid, about 21% to 32% palmitic acid, about 14% to 31% stearic acid, about 0 to 4% palmitoleic acid, about 36% to 50% oleic acid and about 0 to 5% linoleic acid. A typical distribution is 2.5% myristic acid, 29% palmitic acid, 23% stearic acid, 2% palmitoleic acid, 41.5% oleic acid, and 3% linoleic acid. Other similar mixtures, such as those from palm oil and those derived from various animal tallow and lard are also included.

Coconut oil refers to fatty acid mixtures having an approximate carbon chain length distribution of 8% C8, 7% C10, 48% C12, 17% C14, 8% C16, 2% C18, 7% oleic and 2% linoleic acids (the first six fatty acids listed being saturated). Other sources having similar carbon chain length distributions, such as palm kernel oil and babassu kernel oil, are included within the term coconut oil.

A typical fatty acid blend consisted of 5% to 30% coconut fatty acids and 70% to 95% fatty acids ex hardened rice bran oil. Fatty acids derived from other suitable oils/fats such as groundnut, soybean, tallow, palm, palm kernel, etc. may also be used in other desired proportions.

The composition according to the invention will preferably comprise non-soap detergent actives which are generally chosen from both anionic and nonionic detergent actives.

Suitable anionic detergent active compounds include water soluble salts of organic sulphuric reaction products having in the molecular structure an alkyl radical containing from 8 to 22 carbon atoms, and a radical chosen from sulphonic acid or sulphuric acid ester radicals and mixtures thereof.

Examples of suitable anionic detergents are sodium and potassium alcohol sulphates, especially those obtained by sulphating the higher alcohols produced by reducing the glycerides of tallow or coconut oil; sodium and potassium alkyl benzene sulphonates such as those in which the alkyl group contains from 9 to 15 carbon atoms; sodium alkyl glyceryl ether sulphates, especially those ethers of the higher alcohols derived from tallow and coconut oil; sodium coconut oil fatty acid monoglyceride sulphates; sodium and potassium salts of sulphuric acid esters of the reaction product of one mole of a higher fatty alcohol and from 1 to 6 moles of ethylene oxide; sodium and potassium salts of alkyl phenol ethylene oxide ether sulphate with from 1 to 8 units of ethylene oxide molecule and in which the alkyl radicals contain from 4 to 14 carbon atoms; and the reaction product of fatty acids esterified with isethionic acid and neutralised with sodium hydroxide where, for example, the fatty acids are derived from coconut oil and mixtures thereof.

The preferred water-soluble synthetic anionic detergent active compounds are the alkali metal (such as sodium and potassium) and alkaline earth metal (e.g. calcium and magnesium) salts of higher alkyl benzene sulphonates and mixtures with olefin sulphonates and higher alkyl sulphates, and the higher fatty acid monoglyceride sulphates.

Suitable nonionic detergent active compounds can be broadly described as compounds produced by the condensation of alkylene oxide groups, which are hydrophilic in nature, with an organic hydrophobic compound which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Particular examples include the condensation product of aliphatic alcohols having from 8 to 22 carbon atoms in either straight or branched chain configuration with ethylene oxide, such as a coconut oil ethylene oxide condensate having from 2 to 15 moles of ethylene oxide per mole of coconut alcohol; condensates of alkylphenols whose alkyl group contains from 6 to 12 carbon atoms with 5 to 25 moles of ethylene oxide per mole of alkylphenol; condensates of the reaction product of ethylenediamine and propylene oxide with ethylene oxide, the condensate containing from 40 to 80% of polyoxyethylene radicals by weight and having a molecular weight of from 5,000 to 11,000; tertiary amine oxides of structure $R_3NO$, where one group R is an alkyl group of 8 to 18 carbon atoms and the others are each methyl, ethyl or hydroxyethyl groups, for instance dimethyldodecylamine oxide; tertiary phosphine oxides of structure $R_3PO$, where one group R is an alkyl group of from 10 to 18 carbon atoms, and the others are each alkyl or hydroxyalkyl groups of 1 to 3 carbon atoms, for instance dimethyldodecylphosphine oxide; and dialkyl sulphoxides of structure $R_2SO$ where the group R is an alkyl group of from 10 to 18 carbon atoms and the other is methyl or ethyl, for instance methyltetradecyl sulphoxide; fatty acid alkylolamides; alkylene oxide condensates of fatty acid alkylolamides and alkyl mercaptans.

It is also possible to include amphoteric, or zwitterionic detergent actives in the compositions according to the invention.

Suitable amphoteric detergent active compounds that optionally can be employed are derivatives of aliphatic secondary and tertiary amines containing an alkyl group of 8 to 18 carbon atoms and an aliphatic radical substituted by an anionic water-solubilizing group, for instance sodium 3-dodecylamino-propionate, sodium 3-dodecylaminopropane sulphonate and sodium N-2-hydroxydodecyl-N-methyltaurate.

Suitable zwitterionic detergent-active compounds that optionally can be employed are derivatives of aliphatic quaternary ammonium, sulphonium and phosphonium compounds having an aliphatic radical of from 8 to 18 carbon atoms and an aliphatic radical substituted by an anionic water-solubilising group, for instance 3-(N-N-dimethyl-N-hexadecylammonium) propane-1-sulphonate betaine, 3-(dodecylmethyl sulphonium) propane-1-sulphonate betaine and 3-(cetylmethylphosphonium)ethane sulphonate betaine.

Suitable clays for use according to the present invention belonging to the hormite group of the 2:1 type of clay minerals, and having an inverted ribbon configuration and also having sorptive character. Sepiolite and palygorskite are the most common clays of the hormite group.

It is particularly preferred for the present invention to incorporate palygorskite which is synonymous with attapulgite or Attapulgus fuller's earth. The term Attapulgus fuller's earth usually refers to non-swelling sorptive clays, and encompasses both calcium-montmorillonites and clays comprising the mineral attapulgite. Attapulgus clay, sometimes called "Attapulgus fuller's earth," contains in addition to a major portion of attapulgite minor amounts of montmorillonite minerals, sepicilite, quartz or feldspar. The morphology of attapulgite, an aluminium magnesium silicate mineral, differs considerably from that of the layer-like montmorillonite minerals and from the hexagonal platelets of kaolinite.

The shape of the ultimate particles of attapulgite is acicular, and the mineral occurs in a state in which the needles or fibers occur in packets of close-packed fibers. These fibers are relatively short, ranging from about 0.5 to 2.0 micron in length and from about 20 to 60 millimicrons in width. It is particularly preferred to use attapulgite having an average particle size in the range 8-15 microns.

Examples of suitable benefit agents include moisturisers and humectants and include polyols, glycerol, cetyl alcohol, Carbopol 934, ethoxylated castor oil, paraffin oils, lanolin and its derivatives. Silicone compounds such as silicone surfactants like DC3225C (Dow Corning) and/or silicone emollients, and silicone oil (e.g. DC-200 ex-Dow Corning) may also be included. Sun-screens such as 4-tertiary butyl-4'-methoxy dibenzoylmethane (available under the trade name PARSOL 1789 from Givaudan) and/or 2-ethyl hexyl methoxy cinnamate (available under the trade name PARSOL MCX from Givaudan) or other UV-A and UV-B sun-screens may also be included. Water soluble glycols such as propylene glycol, ethylene glycol, glycerol, may be employed at levels up to 10%.

Other inorganic particulates may be optionally incorporated in the formulation, and are especially useful for hard surface cleaning compositions. Preferably, the particulate phase comprises a particulate structurant and/or abrasive which is insoluble in water. In the alternative, the abrasive may be soluble and present in such excess to any water present in the composition that the solubility of the abrasive in the aqueous phase is exceeded, and consequently solid abrasive exists in the composition.

Suitable inorganic particulates can be selected from for example particulate zeolites, calcites, dolomites, feldspars, silicas, silicates, other carbonates, bicarbonates, borates, sulphates and polymeric materials such as polyethylene.

The most preferred inorganic particulates are calcium carbonate (as Calcite), mixtures of calcium and magnesium carbonates (as dolomite), sodium hydrogen carbonate, borax, sodium/potassium sulphate, zeolite, feldspars, talc, koalin and silica.

Calcite, talc, kaolin, feldspar and dolomite and mixtures thereof are particularly preferred due to their low cost and colour.

The inorganic particulate structurants such as alumino silicate may be generated in situ using aluminium sulphate and sodium silicate in the formulation. It is also possible to incorporate readily available sodium alumino-silicate into the formulation.

Other additives such as one or more water insoluble particulate materials such as talc, kaolin, polysaccharides such as starch or modified starches and celluloses may be incorporated.

In terms of production process, the formulation according to the present invention can be prepared by either extrusion or cast route. The invention is carried out in any mixer conventionally used in soap/detergent manufacture and is preferably a high shear-kneading mixer. The clays according to the invention can be incorporated into the soap or detergent active at point in the process.

The details of the invention, its objects and advantages are explained hereunder in greater detail in relation to non-limiting exemplary illustrations.

EXAMPLES

Example 1

Effect of Different Clays on Sebum Re-Accumulation

The detergent compositions incorporating different types of clays were prepared by mixing it with a soap formulation described in table 1.

TABLE 1

| Composition (% wt.) | Ex 1 | Ex 2 | Ex 3 | Ex 4 | Ex 5 | Ex 6 |
|---|---|---|---|---|---|---|
| Soap | 64 | 64 | 28 | 64 | 64 | 64 |
| Bentonite | 16.5 | — | — | — | — | — |
| Talc | — | 16.5 | 60 | — | — | — |
| Rice husk silica | — | — | — | 16.5 | — | — |
| Kaolin + Bentonite | — | — | — | — | 16.5 | — |
| Attapulgite | — | — | — | — | — | 16.5 |
| Linear alkyl benzene sulphonate | 2 | 2 | 2 | 2 | 2 | 2 |
| Sodium lauryl sulphate | 2 | 2 | 2 | 2 | 2 | 2 |
| Minor ingredients | 3.7 | 3.7 | 3.7 | 3.7 | 3.7 | 3.7 |
| Moisture | To 100 | To 100 | To 100 | To 100 | To 100 | To 100 |

Measurement of Re-Accumulation of Sebum

A clinical study was conducted to determine the re-accumulation of sebum that was measured by determining the actual sebum level on the skin together with the oiliness perceived by a consumer.

A panel of volunteers were selected, and the oiliness of their skin was measured by using a sebumeter as described below; this reading was taken as the base level. The volunteers were conditioned for a week, when all of them were required to use the same cosmetic product during the period. The volunteers were provided with soap samples whose composition is described in examples 1 to 6 in Table 1, in a totally randomised design study.

The measurements of shine of the skin, actual sebum level on the skin and the oiliness perceived by a consumer were done immediately after wash, and at regular intervals up to three hours. The data presented in Table 2 is an average value after three hours.

1. Sebum Measurement

The sebum levels on the foreheads of volunteers at various time points during the oiliness reduction study were measured using a Sebumeter SM810 instrument manufactured by Khazaka-Courage, Germany. The sebum values/numbers are represented as microgram/cm$^2$. The data obtained was converted into sebum re-accumulation index calculated as the actual sebum level after three hours subsequent to wash divided by average initial sebum level for each volunteer.

2. Panel Study

A qualitative perception on the oiliness levels of the forehead as a function of time during the study was measured by asking the volunteers to rate themselves on a oiliness line scale rating from 1 to 5, where 1 represents extremely dry skin and 5 represents extremely oily skin. Volunteers giving a score greater than 3 were considered to have an oily perception, and this was translated into % data.

TABLE 2

| | Ex 1 | Ex 2 | Ex 3 | Ex 4 | Ex 5 | Ex 6 |
|---|---|---|---|---|---|---|
| Subum Re-accumulation Index at 3 hours | 0.88 | 1.01 | 0.89 | 0.94 | 1.03 | 0.84 |
| % people who perceive skin oiliness | 78% | 73% | 82% | 87% | 91% | 65% |

The data presented in table 2 shows that incorporation of attapulgite in soap bars significantly decreases the sebum re-accumulation on the skin after wash. The effect of attapulgite is superior to that of other clays like bentonite, or a combination of bentonite and kaolin, or other fillers like talc or silica.

The invention claimed is:

1. A method of reducing re-accumulation of sebum on skin and reducing perceived skin oiliness using soap or non-soap surfactant containing wash off compositions which method comprises using on the skin for at least about a one week conditioning process a detergent bar composition comprising:

i. about 64% to 80% by wt. detergent active comprising soap or non-soap surfactants, wherein said bar is predominantly soap based and comprises at least about 64% soap;

ii. at least about 16% by wt. clay belonging to the hormite group of the 2:1 type of clay minerals, and having an inverted ribbon configuration and also having sorptive character; and iii water;

wherein the clay is palygorskite which is synonymous with attapulgite or Attapulgus fuller's earth;

wherein the shape of the ultimate particles of attapulgite is acicular.

2. A method according to claim 1, wherein the non-soap detergent active used in the detergent composition is selected from the group consisting of anionic and nonionic detergent actives.

3. A method according to claim 1, wherein the average particle size of the palygorskite clay used in the detergent composition is in the range 8 to 15 microns.

4. A method according to claim 1, wherein said detergent composition additionally comprises a benefit agent.

5. A method as claimed in claim 4 wherein the benefit agent used in the detergent composition is selected from the group consisting of moisturizers, humectants, and sunscreens.

6. A method as claimed in claim 5 wherein the moisturisers and humectants are selected from the group consisting of polyols, glycerol, cetyl alcohol, carbopol 934, ethoxylated castor oil, paraffin oils, lanolin and its derivatives, silicone compounds selected from the group consisting of silicone surfactants, silicone emollients, and silicone oils.

7. A method as claimed in claim 5 wherein the moisturisers and humectants are present at levels up to 10%.

8. A method as claimed in claim 5 wherein the sunscreen is selected from the group consisting of 4-tertiary butyl-4'-methoxy dibenzoylmethane (available under the trade name PARSOL 1789 from Givaudan) and/or 2-ethyl hexyl methoxy cinnamate (available under the trade name PARSOL MCX from Givaudan), or other UV-A and UV-B sunscreens.

9. A method according to claim 1, wherein said bar composition is prepared by either extrusion or cast route.

* * * * *